US006471273B1

(12) United States Patent
Friedrich et al.

(10) Patent No.: US 6,471,273 B1
(45) Date of Patent: Oct. 29, 2002

(54) LIFTING MAGNET WITH ROLLER CAM RELEASE MECHANISM

(75) Inventors: Peter Friedrich, Boyne City, MI (US); Bud Shear, Waterford, MI (US)

(73) Assignee: Industrial Magnetics, Inc., Boyne City, MI (US)

( * ) Notice: Subject to any disclaimer, the term of this patent is extended or adjusted under 35 U.S.C. 154(b) by 0 days.

(21) Appl. No.: 09/638,249

(22) Filed: Aug. 14, 2000

(51) Int. Cl.[7] ..... B66C 1/04
(52) U.S. Cl. ..... 294/65.5; 335/285
(58) Field of Search ..... 294/15, 17, 64.1, 294/65.5; 254/120, 131; 335/285, 291, 293, 295

(56) References Cited

U.S. PATENT DOCUMENTS

| | | | | | |
|---|---|---|---|---|---|
| 662,342 | A | * | 11/1900 | Berry | 294/17 |
| 2,086,318 | A | * | 7/1937 | Jackson | 294/17 |
| 2,869,047 | A | * | 7/1959 | Smit et al. | 335/285 |
| 2,954,257 | A | * | 9/1960 | Besuch et al. | 294/65.5 |
| 3,014,751 | A | | 12/1961 | Smith | |
| 3,319,989 | A | | 5/1967 | Ross | |
| 3,442,399 | A | | 5/1969 | Snavely | |
| 3,871,054 | A | * | 3/1975 | Schaefer | 254/131 |
| 4,488,706 | A | * | 12/1984 | Kono | 294/15 |
| 5,066,936 | A | | 11/1991 | Hsu | |
| 5,988,717 | A | * | 11/1999 | Foust | 294/64.1 |

FOREIGN PATENT DOCUMENTS

| | | | | |
|---|---|---|---|---|
| DE | 2935-475 | * | 3/1981 | 294/65.5 |
| SU | 1423488 | * | 9/1988 | 294/65.5 |
| SU | 1675184 | * | 9/1991 | 294/65.5 |

* cited by examiner

*Primary Examiner*—Dean J. Kramer
(74) *Attorney, Agent, or Firm*—Young & Basile, P.C.

(57) ABSTRACT

The invention is a magnetic lifting device having a lever-operated cam and roller combination, which facilitates removal of the magnetic lifting device from a workpiece, wherein the cam-mounted roller is free to rotate, eliminating the potential for marring the service of the workpiece when the cam is operated.

11 Claims, 3 Drawing Sheets

FIG-1A
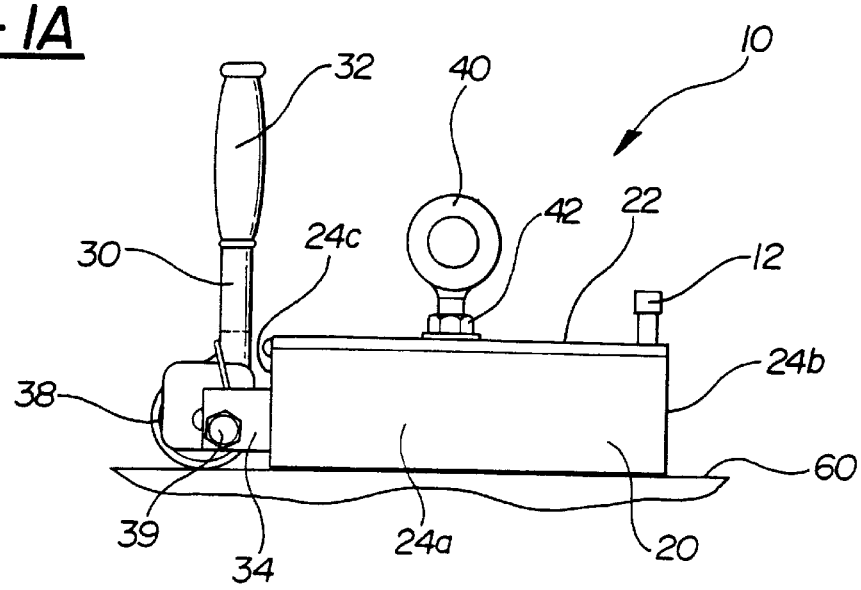
FIG-1B
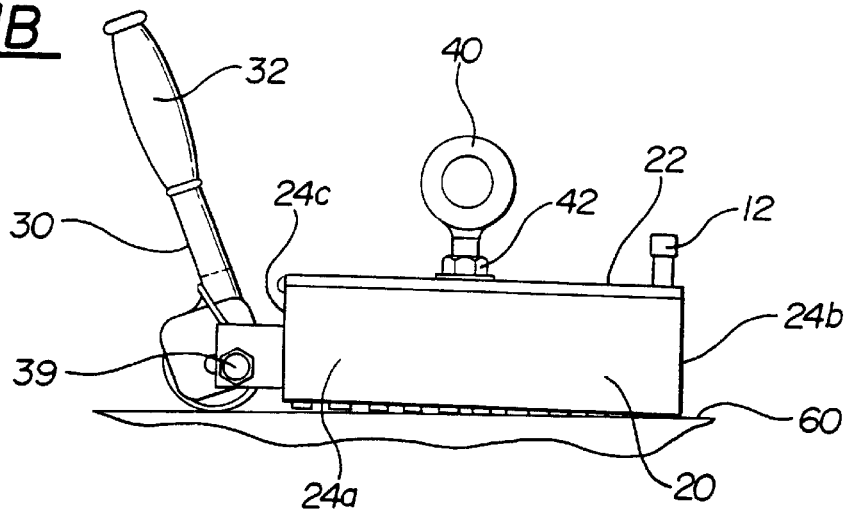
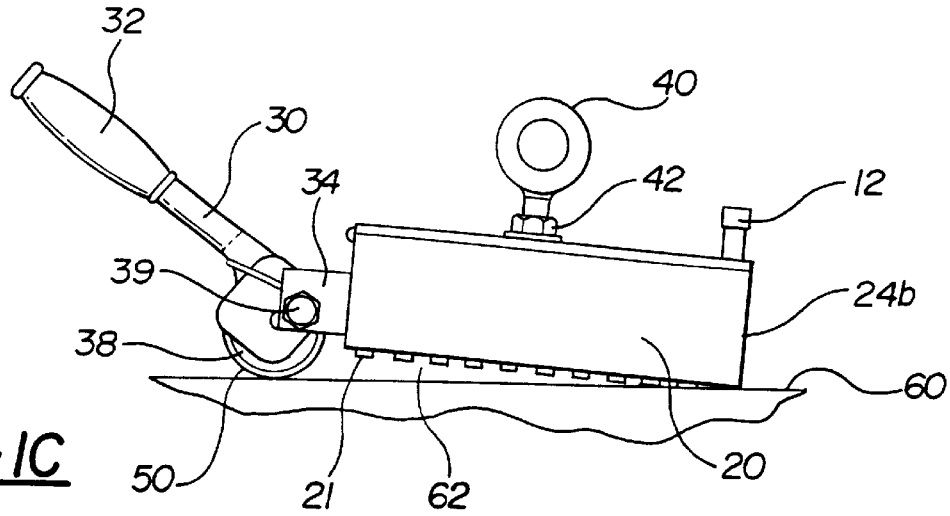
FIG-1C

LIFTING MAGNET WITH ROLLER CAM RELEASE MECHANISM

FIELD OF THE INVENTION

The invention pertains to permanent magnetic work holders, and, more specifically, to magnetic work holders having release mechanisms to facilitate separation of the work holder from the workpiece.

BACKGROUND OF THE INVENTION

Both permanent magnet and electromagnetic devices are commonly used in industry for handling ferromagnetic materials. In a typical installation, magnetic lifts are used to lift, or otherwise manipulate, workpieces of ferromagnetic material, such as steel. By way of example, a magnetic lift, secured to a hoist or robotic arm, is brought into contact with a workpiece, such as a steel sheet. So long as the magnetic attraction or holding power of the magnet exceeds the weight of the workpiece, the workpiece may be lifted, moved or otherwise manipulated so long as the magnet remains in contact with the surface of the workpiece. In this fashion, ferromagnetic metallic components may be conveniently transported between locations in the industrial environment, for example, without the need for otherwise gripping the workpiece or providing attach points on the workpiece.

This type of magnetic lift is very well known, and has been in industrial use for a long period of time. Typically, such lifts utilizing permanent magnets are comprised of a housing or body containing one or more permanent magnets. The body is provided with a lift point to which may be attached a hoist or similar device. One surface of the complete magnetic lifting assembly so described is designed to be complimentary in shape to the workpiece being lifted. In a wide variety of applications, the workpiece is relatively flat, meaning that the corresponding contacting face of the magnetic lift is also flat.

While this basic configuration is both convenient and effective, it presents certain significant problems when permanent magnets are the magnets of choice for the lift. Permanent magnets are capable of exerting substantial magnetic forces. In particular, modern rare earth-type magnets, such as neodymium, exhibit enormously powerful magnetic attraction when properly selected for size, number and alignment. Since the forces exerted by permanent magnet assemblies are constant, separating the magnetic lift from the workpiece after the workpiece has been manipulated or moved presents serious challenges.

Basically, in order to separate the magnetic lift from the workpiece, the workpiece must be held, in some fashion, while sufficient force is applied to the magnetic lift to cause it to part from the workpiece. In most applications, this separation is most easily accomplished by lifting one end or one side of the permanent magnet lift from the workpiece, thereby creating an air cap. Once a substantial portion of the contacting surface of the magnet has been separated from the workpiece, the magnetic attraction between the lift and the workpiece is sufficiently reduced to permit the magnetic lift to be completely withdrawn.

A number of methods have been devised for separating the magnetic lift from the workpiece. Smith, in U.S. Pat. No. 3,014,751, teaches the placement of a camming release handle in the center of the magnetic assembly. The camming element, pivotably connected to the handle, is brought into contact with the surface by rotation of the handle. Ross, in U.S. Pat. No. 3,319,989, teaches a similar technique, whereby the camming element and handle combination are mounted near one end of the magnetic lift body. Both of these techniques, however, result in substantial marring of the surface of the workpiece. The degree of marring is directly related to the hardness of the workpiece, camming element, and the force required to separate the lift from the workpiece. In addition, earlier designs exhibit substantial friction between the camming mechanism and the workpiece.

There is a need, accordingly, for an improved magnetic lift and associated release mechanism, which I describe herein.

SUMMARY OF THE INVENTION

The invention is a self-contained, portable, permanent magnet-type lift assembly which is provided with a non-marring, low friction release mechanism. The release mechanism is secured to one end of the magnetic lift assembly, and is in the general form of a rotatable cam/handle combination. The surface of the cam which contacts the workpiece is a pivoting roller provided with a non-marring surface. Disengagement of the lift from the workpiece is accomplished by bringing the roller cam into contact with the surface of the workpiece, and using the mechanical advantage provided by the cam handle to separate the lift from the workpiece. The cam is designed as a pivoting roller mounted on a bearing, permitting the cam roller surface to roll across the surface of the workpiece as pressure is applied to the operating handle, thereby reducing both friction and marring of the workpiece surface.

DETAILED DESCRIPTION OF THE PREFERRED EMBODIMENT

Figure 2:
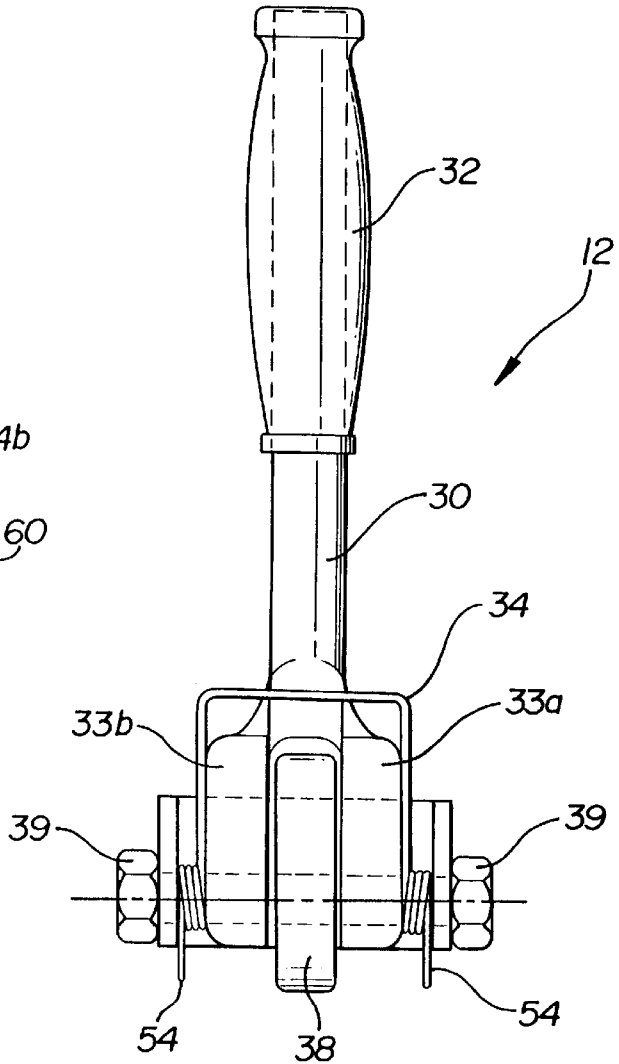
FIG. 2 is a front view of the invention showing the release mechanism.

As shown in FIG. 1, the present invention, comprising a magnetic lift assembly 10, is further comprised of a magnet housing 20 having a top 22 and sides 24A, 24B, 24C and 24D. Preferably, the housing is in the form of a rectangular box, and is provided with a lift point 40 attached to the housing 20 through lift point attachment 42. Typically, lift point attachment 42 may be a threaded fastener, such as a nut, or a reinforced threaded recess, either of which may be attached to the top 22 of housing 20. The lift point 40 is then threadably attached to attachment 42. Other methods of attachment, such as welding, however, are equally useful.

With reference now to FIGS. 1*a*–1*d*, further detail of the invention is displayed showing a plurality of magnetic elements 21. Preferably, the magnetic elements are selected from the various classes or types of magnets material, such as ceramic or rare earth magnets. Typically, an array of magnets 21 and intervening pole pieces is utilized to concentrate the magnetic flux of the magnets 21, thereby in creasing the lifting power of the assembly. The magnets 21 and pole pieces are secured within the housing utilizing any of a variety of well known means.

Figure 4:
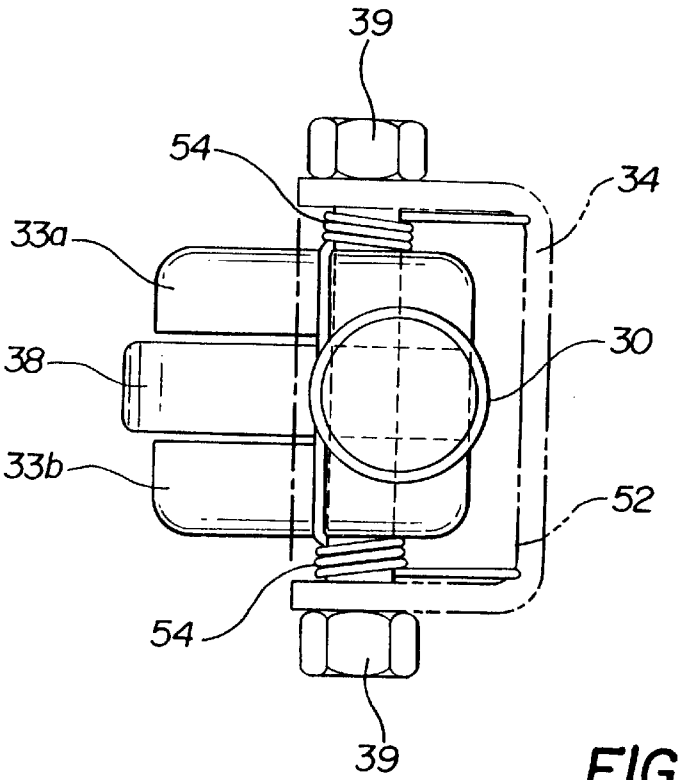
FIG. 4 is a top view of the release mechanism.
Figure 3:
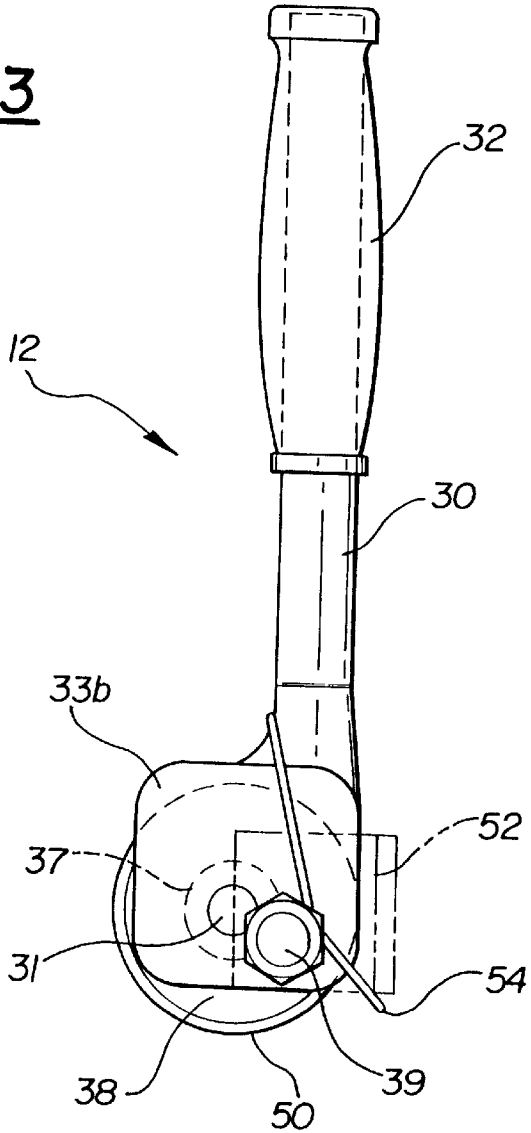
FIG. 3 is a side view of the release mechanism.

As shown in FIGS. 2–4, one end of the housing is provided with one or more cam attachment brackets 34. Cam assembly 12 is pivotably connected to the cam attachment bracket 34 in such a way as to permit the roller element 38 of cam assembly 12 to rest on or slightly above the surface of the workpiece 60 when the magnetic lift assembly 10 is in the lifting configuration depicted in FIG. 1*a*. Cam assembly 12 further comprises handle 30 and grip 32 which are unitary with roller arms 33*a*, 33*b*. Roller arms 33*a* and 33*b* are provided with bearings 37 and with axle element 31. Axle element 31 provides the pivot for roller 38. Preferably, sealed ball or roller bearing assemblies are utilized for the bearings 37.

Cam attachment bracket 34 is likewise provided with cam bolts 39, and cam assembly 12 is attached to cam attachment flange 34 at a position offset from the centerline of the roller axle utilizing cam bolts 39. This pivotal connection between the cam assembly 12 and cam attachment flange 34 permits the handle of assembly 12 to be rotated toward the workpiece, thereby bringing the roller surface 50 into contact with the workpiece 60 as shown in FIGS. 1*a*–1*d*. In the preferred embodiment, cam attachment flange 34 is provided with a stop 52 which limits the rotational movement of handle 30, to prevent trapping or pinching of the operator's hands between the handle and the workpiece. Further, handle 30 is provided with return springs 54 interconnecting the handle and the magnetic housing, reducing the amount of force required to return the handle to its upward and disengaged position.

The roller surface 50 is a durable machined surface preferably of brass or steel with rounded edge for long life, thereby reducing the amount of damage done to the surface of the workpiece as the handle 30 is rotated from its vertical to its horizontal position. Further, the surface 50 of the roller 38 is free to travel or roll across the surface of the workpiece, thereby preventing the roller surface from scuffing or otherwise marring the surface of the workpiece.

Figure 1D:
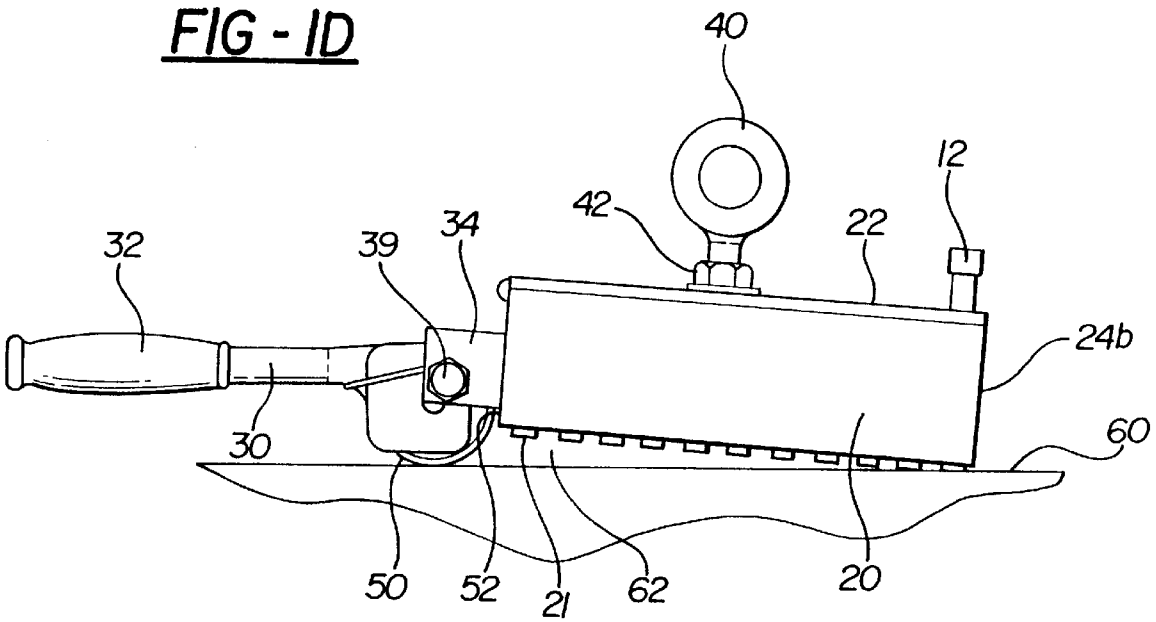
FIG. 1 is a collection of side views of the invention shown in relationship to a workpiece, with the release mechanism in the retracted intermediate and extended positions.

Operation of the device will be best understood by examining FIGS. 1*a*–1*d*. In FIG. 1*a*, the cam assembly is in the retracted position, with the surface of roller 38 either slightly above or just barely in contact with the upper surface of workpiece 60. In this position, the magnetic elements 21 are in intimate contact with the surface of the workpiece, creating strong magnetic holding. When it is desired to release the magnetic lift assembly from the workpiece, the handle 30, provided with a grip 32, is manually rotated downward toward the work surface as shown in FIG. 3. Because the pivot point at which the magnetic assembly is attached to the cam attachment flange 34 is selected to insure a mechanical advantage, forcing the roller 38 downward against the upper surface of the workpiece 60, prying the lift assembly away from the work surface and creating an air gap 62 which grows progressively larger as the handle is rotated from the vertical to the horizontal position. The roller is free to rotate on its axle/bearing combination, allowing the roller surface 50 to roll smoothly along the upper surface of the workpiece 60. Stop 52 prevents the handle 30 from contacting the workpiece, and insures that a gap between the workpiece and the handle remains even at full downward travel of the handle, thereby protecting the hands of the operator.

Occasionally, the magnetic attraction between the workpiece and the magnetic lift is sufficiently large as to make it difficult for the magnets and workpiece to be separated, even utilizing the mechanical advantage associated with the operation of the handle 30 in relationship to the workpiece 60 and the magnetic housing 20. In that circumstance, it may be necessary to apply substantially greater leverage to the lift and the workpiece to effect separation. To this end, the housing 20 is provided with a threaded release 12, as shown in FIGS. 1*a*–1*d*. The threaded release is threadably coupled to the housing in such a fashion as to permit the threaded release to be rotated within a corresponding threaded cavity in the housing 20. Rotating the threaded release causes the end of the threaded release opposite the head thereof to be brought in contact with the workpiece. Further turning or tightening of the threaded release 12 drives the end of the threaded release against the workpiece, affecting separation of the workpiece and the magnetic lift at the end of the housing 20 opposite the release mechanism 12. Once an air gap has been created between the end of the housing 20 and the workpiece 60 in the proximity of housing side 24*b*, further separation of the lift and the workpiece can be easily effected by operation of the handle 30, if necessary.

To better understand the functionality of the stop 52, it will be appreciated that the axis about which the handle assembly 12 rotates is defined by the axial center of cam bolts 39. The position of cam bolts 39 in relation to roller arms 33*a* and 33*b* is selected so as to offset the axis of axle element 31 from the axis of cam bolts 39. In this fashion, rotation of the handle assembly 12 from the retracted or upright position shown in FIG. 1*a* to the extended position shown in FIG. 1*d* serves to move roller surface 50 from a point distant from housing side 22*c* to a position wherein the roller surface 50 is brought into contact with the lower portion of side 24*c*, designated as stop 52. As will be apparent to those skilled in the art, proper selection of the distance of the axis of cam bolts 39 from the side 24*c*, with due consideration for the diameter of roller 38 insures that roller surface 50 will be brought into contact with stop 52, after lifting housing 20 from the workpiece, but prior to the time handle 32 contacts the plane of the workpiece.

Once the magnetic lift assembly has been separated from the workpiece as above-described, the handle may be rotated again to its vertical position, thereby retracting the roller cam to its initial position in preparation for subsequent use.

We claim:

1. In a magnetic lifting and holding apparatus of the type comprising a plurality of permanent magnets, a housing for said plurality of said magnets, a lever element for urging said apparatus apart from a workpiece, said lever element having a proximal end for actuation of said lever element and a distal end for contacting said workpiece, said lever element further comprising a roller element pivotally attached to said distal end of said lever element, and said roller element further comprising an axle radially offset by an offset distance from the central axis of said roller element, said axle spaced apart from said housing at a pivot point, the improvement comprising:

said lever element disposed proximate one end of said housing, and said roller element attached to said distal end of said lever element, whereby the outer circumferential surface of said roller element may be brought into contact with said workpiece upon movement of said lever element, said roller element having a radial dimension less than the minimum distance between said pivot point and said housing, the dimension comprising the sum of said offset distance and said radial dimension of said roller element being greater than said minimum distance between said pivot point and said housing, whereby rotation of said lever element about said pivot point brings said outer circumferential surface into contact with said housing.

2. The apparatus of claim 1, wherein said outer circumferential surface of said roller element further comprises a relatively low friction and non-marring material.

3. The apparatus as described in claim 2, said material being brass.

4. The apparatus as described in claim 2, said material being steel.

5. The apparatus of claim 1, further comprising means whereby said lever element and said housing cooperate to limit the travel of said lever element between a first, retracted position away from said workpiece, and second, extended position nearer said workpiece, the distance between said lever element and said workpiece in said second position being more than a predetermined distance.

6. In a magnetic lifting and holding apparatus of the type comprising a plurality of permanent magnets, a housing for said plurality of said magnets, a lever element urging said apparatus apart from a workpiece, said lever element having a proximal end for actuation of said lever element and a distal end for contacting said workpiece, the improvement comprising:

said lever element disposed proximate one end of said housing, and a roller element attached to said distal end of said lever element and spring bias means for urging a predetermined position of said lever element, whereby the outer circumferential surface of said roller element may be brought into contact with said workpiece upon movement of said lever element.

7. The apparatus of claim 6, wherein said outer circumferential surface of said roller element further comprises a relatively low-friction and non-marring material.

8. The apparatus of claim 7, wherein said material is brass.

9. The apparatus of claim 7, wherein said material is steel.

10. An apparatus according to claim 6, wherein said lever element and said housing cooperate to limit the travel of said lever element between a first, retracted position away from said workpiece, and a second, extended position nearer said workpiece, the distance between said lever element and said workpiece in said second position being more than a predetermined distance.

11. An apparatus as in any one of the preceding claims, further including secondary relief means comprising a threaded opening in said housing remote from said one end of said housing, said opening communicating with the bottom of said housing, a threaded shaft engaged with said opening and rotatable therein, whereby one end of said threaded shaft may be brought into contact with said workpiece upon rotation of said threaded shaft.

* * * * *